US009897971B2

(12) United States Patent
Ueno

(10) Patent No.: US 9,897,971 B2
(45) Date of Patent: Feb. 20, 2018

(54) POWDER COLLECTING DEVICE AND PROCESSING APPARATUS INCLUDING THE SAME

(71) Applicant: FUJI XEROX CO., LTD., Tokyo (JP)

(72) Inventor: Hirofumi Ueno, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/452,061

(22) Filed: Mar. 7, 2017

(65) Prior Publication Data

US 2018/0011441 A1 Jan. 11, 2018

(30) Foreign Application Priority Data

Jul. 7, 2016 (JP) ..... 2016-135234
Nov. 11, 2016 (JP) ..... 2016-220896

(51) Int. Cl.
*G03G 21/20* (2006.01)
*G03G 15/095* (2006.01)

(52) U.S. Cl.
CPC ..... *G03G 21/206* (2013.01); *G03G 15/095* (2013.01)

(58) Field of Classification Search
CPC ..... G03G 15/095; G03G 21/206
See application file for complete search history.

(56) References Cited

U.S. PATENT DOCUMENTS

2008/0240768 A1* 10/2008 Segawa ..... G03G 15/1695 399/92

FOREIGN PATENT DOCUMENTS

JP 2007-232962 A 9/2007
JP 2015-75744 A 4/2015

* cited by examiner

*Primary Examiner* — Hoang Ngo
(74) *Attorney, Agent, or Firm* — Sughrue Mion, PLLC

(57) ABSTRACT

A powder collecting device includes a collecting container and a ventilation passage. The collecting container is removably attachable to a housing of a processing apparatus including a powder processing unit, has one or more collecting openings through which heat-melting powder transported from the powder processing unit is collected, and includes an accommodation space capable of accommodating the collected powder. The ventilation passage is partitioned from the accommodation space of the collecting container. Airflow generated by an airflow generator passes through the ventilation passage. The ventilation passage extends in a longitudinal direction of the collecting container, and has an inlet through which the airflow is introduced and a ventilation hole formed in a downstream section of the ventilation passage in a direction of the airflow.

13 Claims, 15 Drawing Sheets

POWDER COLLECTING DEVICE AND PROCESSING APPARATUS INCLUDING THE SAME

CROSS-REFERENCE TO RELATED APPLICATIONS

This application is based on and claims priority under 35 USC 119 from Japanese Patent Application No. 2016-135234 filed Jul. 7, 2016 and No. 2016-220896 filed Nov. 11, 2016.

BACKGROUND

Technical Field

The present invention relates to a powder collecting device and a processing apparatus including the powder collecting device.

SUMMARY

According to an aspect of the invention, there is provided a powder collecting device including a collecting container and a ventilation passage. The collecting container is removably attachable to a housing of a processing apparatus including a powder processing unit, has one or more collecting openings through which heat-melting powder transported from the powder processing unit is collected, and includes an accommodation space capable of accommodating the collected powder. The ventilation passage is partitioned from the accommodation space of the collecting container. Airflow generated by an airflow generator passes through the ventilation passage. The ventilation passage extends in a longitudinal direction of the collecting container, and has an inlet through which the airflow is introduced and a ventilation hole formed in a downstream section of the ventilation passage in a direction of the airflow.

BRIEF DESCRIPTION OF THE DRAWINGS

Exemplary embodiments of the present invention will be described in detail based on the following figures, wherein.

DETAILED DESCRIPTION

Summary of Exemplary Embodiment

Figure 1A:
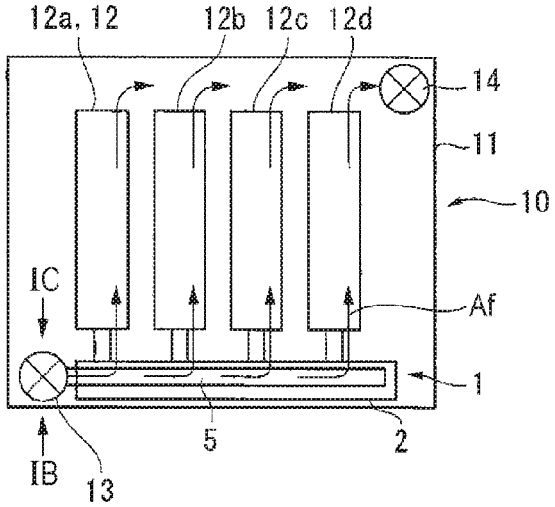
FIG. 1A is a schematic plan view illustrating a processing apparatus according to an exemplary embodiment of the present invention is applied.

In an exemplary embodiment, as illustrated in FIG. 1A, a processing apparatus 10 that uses powder includes one or more powder processing units 12 (powder processing units 12*a* to 12*d* in this example) that are disposed in a housing 11 and that perform a process by using the powder, and a powder collecting device 1 that collects the powder transported from the powder processing units 12.

The processing apparatus 10 may be any appropriate type of processing apparatus as long as the processing apparatus 10 includes the powder processing units 12 that perform a process by using powder (for example, imaging units that visualize electrostatic latent images by using developer as the powder).

Figure 1B:
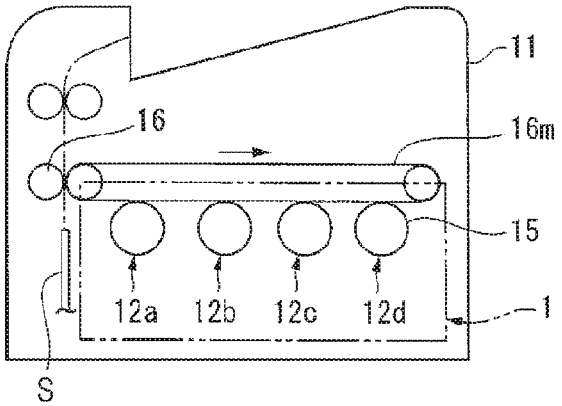
FIG. 1B illustrates the processing apparatus viewed in the direction of arrow IB in FIG. 1A.
Figure 1C:
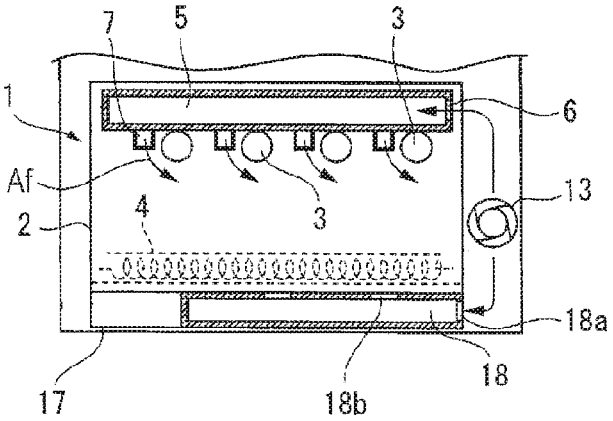
FIG. 1C illustrates the processing apparatus viewed in the direction of arrow IC in FIG. 1A.

In particular, in the present exemplary embodiment, as illustrated in FIGS. 1A to 1C, a powder collecting device 1 includes a collecting container 2 and a ventilation passage 5. The collecting container 2 is removably attachable to a front section of the housing 11 of the processing apparatus 10 including the powder processing units 12. The collecting container 2 has one or more collecting openings 3 through which heat-melting powder transported from the powder processing units 12 is collected, and includes an accommodation space capable of accommodating the collected powder. The ventilation passage 5 is partitioned from the accommodation space of the collecting container 2. Airflow Af generated by an airflow generator 13 passes through the ventilation passage 5. The ventilation passage 5 extends in a longitudinal direction of the collecting container 2, and has an inlet 6 through which the airflow Af is introduced and a ventilation hole 7 formed in a downstream section of the ventilation passage 5 in a direction of the airflow Af.

In the above-described technical feature, the collecting container 2 may be any type of collecting container that has one or more collecting openings 3 and that is removably attachable to a front section of the housing 11 at a predetermined location. The collecting container 2 may be removably attached by retaining the collecting container 2 at a predetermined installation position in such a manner that the collecting container 2 is extractable along a guide or pivotable about a bottom portion thereof.

The collecting container 2 is not limited as long as it collects the heat-melting powder (for example, imaging powder such as toner) transported from the powder processing units 12. The collecting container 2 may be configured to either store the collected powder or transport the collected powder to another collecting container.

The ventilation passage 5 is not limited as long as it is partitioned from the accommodation space of the collecting container 2. The ventilation passage 5 may be provided on either an exterior wall or an interior wall of the collecting container 2. The ventilation passage 5 may be either integrated with the collecting container 2 or formed separately from the collecting container 2. The member that defines the ventilation passage 5 is required to allow the airflow Af to pass through the ventilation passage 5. The inlet 6 may be provided so that the airflow Af generated by the airflow generator 13 (fan or blower) passes through the ventilation passage 5. One or more ventilation holes 7 may be provided in a downstream section of the ventilation passage 5 in the direction of the airflow Af. Although the airflow generator 13 basically supplies air to the ventilation passage 5, the airflow generator 13 may also serve to discharge air from the ventilation passage 5.

A representative example of the powder processing apparatus according to the exemplary embodiment will now be described.

The ventilation passage 5 may pass by the collecting openings 3 of the collecting container 2. In this example, the heat-melting powder that has been transported to the collecting openings 3 is cooled, so that clogging of the powder, which easily melts, is suppressed. When plural collecting openings 3 are provided, the ventilation passage 5 may pass by all of the collecting openings 3. However, the ventilation passage 5 may instead pass by at least one of the collecting openings 3.

The ventilation holes 7 may open toward a space around the powder processing units 12 in the housing 11. In this example, the airflow Af flows toward the space around the powder processing units 12 from the ventilation holes 7, so that contamination of the environment around the powder processing units 12 is suppressed.

A member that defines the ventilation passage 5 may be removably attachable to the collecting container 2. In this example, since the member that defines the ventilation passage 5 is removably attached to the collecting container 2, the collecting container 2 additionally provides a ventilation function as necessary.

The member that defines the ventilation passage 5 may be attached to the exterior wall of the collecting container 2. In this case, the member that defines the ventilation passage 5 may be attached to the exterior wall of the collecting container 2 at any location without taking, for example, the layout of components disposed in the collecting container 2 into consideration.

The ventilation passage 5 may be disposed above the collecting openings 3 in the collecting container 2. In this example, since the ventilation passage 5 is disposed above the collecting openings 3 in the collecting container 2, the region around the collecting openings 3 disposed below the ventilation passage 5 is cooled by the airflow Af that flows through the ventilation passage 5.

A representative example of the collecting container 2 contains a transporting member 4 that is disposed below the collecting openings 3 and that transports the collected powder. The collecting container 2 has a discharge opening (not shown) at the bottom of a downstream section of the collecting container 2 in a direction in which the transporting member 4 transports the powder. The powder is discharged through the discharge opening and stored in a disposal container 17. In this example, the powder collected from the powder processing units 12 is transported to the disposal container 17. The collecting container 2 provided with the ventilation passage 5 is used not for disposal but to transport the collected powder.

A representative example of the processing apparatus 10 includes a first airflow generator (which corresponds to the airflow generator 13) and a second airflow generator 14. The first airflow generator is disposed at one front corner of the housing 11 and generates the airflow Af toward the inlet 6 of the ventilation passage 5. The second airflow generator 14 is disposed at a corner of a rear section of the housing 11, the rear corner being diagonally opposite the location of the first airflow generator 13. The second airflow generator 14 generates airflow in such a direction that the airflow Af that has flowed into the space in the housing 11 from the ventilation holes 7 in the ventilation passage 5 flows out of the housing 11. In this example, the first airflow generator 13 and the second airflow generator 14 are disposed in the housing 11, and the airflow Af introduced through the ventilation passage 5 of the powder collecting device 1 is guided into the space in the housing 11 and toward the powder processing units 12. Since the first airflow generator 13 and the second airflow generator 14 are diagonally opposite each other, the airflow Af flows over the entire region of the space in the housing 11.

As illustrated in FIG. 1C, the processing apparatus 10 may include the airflow generator 13 that is disposed at one front corner of the housing 11 and that generates airflow; an upper branch pipe (not shown) through which a portion of the airflow Af generated by the airflow generator 13 branches off upward and is guided to the inlet 6 of the ventilation passage 5; a lower branch pipe (not shown) through which a portion of the airflow Af generated by the airflow generator 13 branches off downward; and a lower ventilation passage 18 that is disposed below the powder processing units 12 in the housing 11 and that is partitioned from a space in the housing 11. The lower ventilation passage 18 has an inlet 18*a* connected to the lower branch pipe, and a ventilation hole 18*b* that opens toward a space below the powder processing units 12. In this example, the airflow Af generated by the airflow generator 13 is divided into upward and downward airflows. The upward airflow is guided into the space in the housing 11 through the ventilation passage 5 of the powder collecting device 1 as upper airflow. The downward airflow is guided into the space in the housing 11 through the lower ventilation passage 18 as lower airflow.

When the present invention is applied to an image forming apparatus that is the processing apparatus 10 that uses developer as the powder, each powder processing unit 12 may include an image carrier 15 capable of carrying an electrostatic latent image; a developing device (not shown) that develops the electrostatic latent image on the image carrier 15 into a visible image by using developer that serves as the powder; a transfer device 16 that transfers the visible image developed by the developing device onto a recording medium; and a cleaning device (not shown) that removes the developer that remains on the image carrier 15. The powder collecting device 1 collects the developer transported from at least one of the cleaning device, the transfer device 16, or the developing device.

In this example, the developer that has been removed by the cleaning device is collected. When the transfer device 16 is, for example, an intermediate transferring device, the developer removed by a cleaning device for an intermediate transfer body 16*m* is collected. When the transfer device 16 is a direct transferring device, the developer removed by a cleaning device attached to a transfer member is collected. When two-component developer containing toner and carrier, for example, is used in the developing device, the toner is consumed while the carrier is not consumed. Therefore, when the developer becomes old, there is a risk that the charging characteristics will be adversely affected. To avoid this, the old developer is collected.

In a representative example of the image forming apparatus that is the processing apparatus 10 that uses the developer as the powder, the powder collecting device 1 collects at least the developer transported from the cleaning device. The ventilation holes 7 in the ventilation passage 5 face a space above or beside the cleaning device of each powder processing unit 12 or a space above the developing device of each powder processing unit 12.

The cleaning device generally includes a transporting member that transports the removed developer toward the powder collecting device 1. Since the developing devices uses toner as the developer, a toner cloud is easily generated around the developing devices. In this example, the ventilation holes 7 in the ventilation passage 5 face a space above or beside the cleaning device. Therefore, the airflow Af that flows around the cleaning device cools the transporting member that transports the developer toward the powder collecting device 1, thereby reducing the risk that the developer will adhere to the transporting member. In addition, the ventilation holes 7 in the ventilation passage 5 face the space above the developing devices. Therefore, even when there is a toner cloud that floats around the developing devices, the airflow Af that flows around the developing devices blows the toner cloud away, and the toner may be collected by a filter or the like (not shown).

In another representative example of this type of image forming apparatus, the transfer device 16 includes the intermediate transfer body 16*m* onto which the visual images formed on the image carriers 15 by using the developer are transferred before being transferred onto the recording medium S. The intermediate transfer body 16*m* is disposed above the image carriers 15. The ventilation holes 7 in the ventilation passage 5 face a space below the intermediate transfer body 16*m*. In this example, when the intermediate transfer body 16*m* is disposed above the image carriers 15 in an intermediate-transfer image forming apparatus, the ventilation holes 7 in the ventilation passage 5 of the powder collecting device 1 face the space below the intermediate transfer body 16*m*. Even when there is a toner cloud that floats around the developing devices, the toner cloud does not adhere to the intermediate transfer body 16*m*, and is blown away by the airflow Af discharged from the ventilation passage 5 through the ventilation holes 7.

The present invention will be described in more detail based on an exemplary embodiment illustrated in the attached drawings.

Exemplary Embodiment 1

Figure 2:
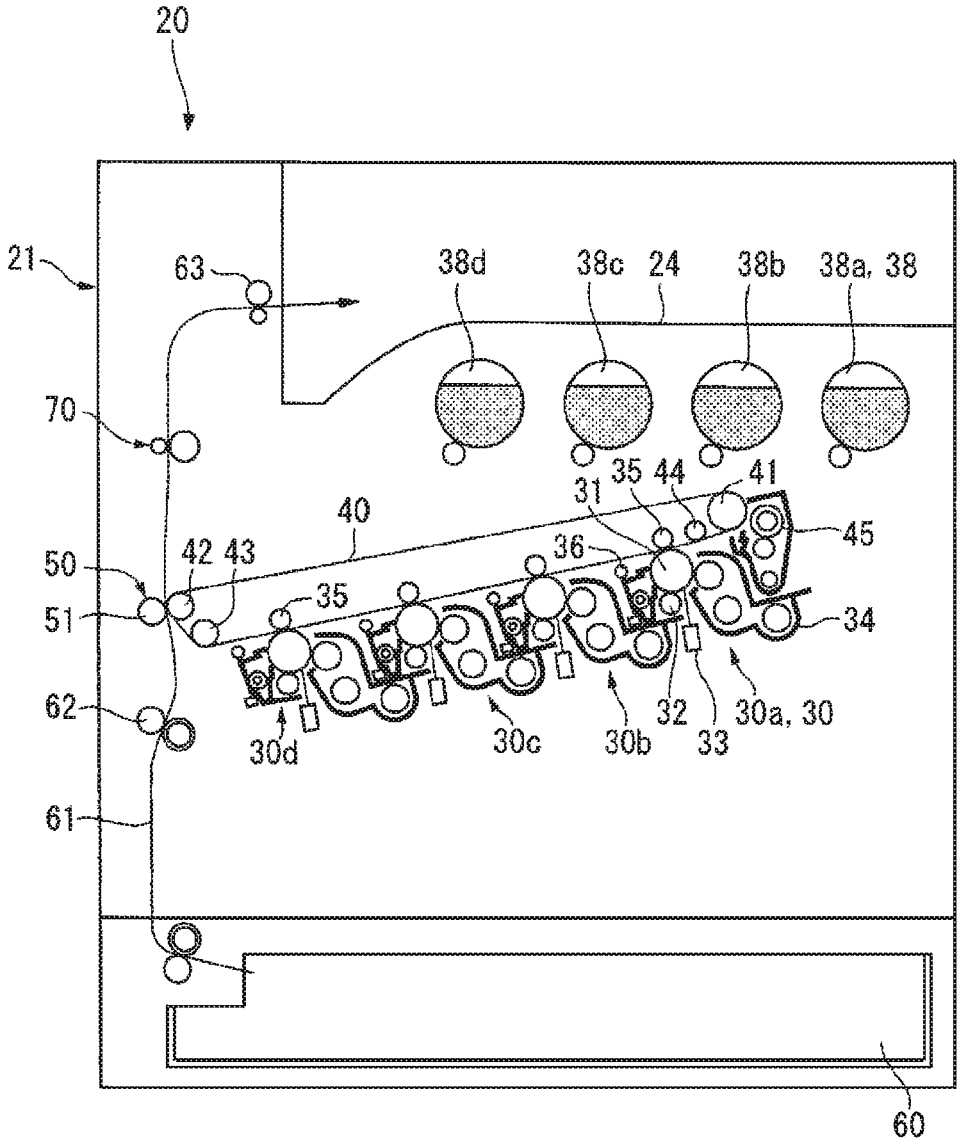
FIG. 2 illustrates the overall structure of an image forming apparatus, which is a processing apparatus according to Exemplary Embodiment 1.

FIG. 2 is a perspective view illustrating the overall structure of an image forming apparatus 20, which serves as a powder processing apparatus according to Exemplary Embodiment 1.

Referring to FIG. 2, the image forming apparatus 20 includes a housing 21 that houses image forming elements. The image forming elements includes an imaging element that forms an image on a recording medium and an image reading element (not shown) that reads a document image to be formed on the recording medium (not shown).

In the present exemplary embodiment, the imaging element includes image forming units 30 (more specifically, image forming units 30*a* to 30*d*) that electrophotographically form plural color images; an intermediate transfer body 40 that is, for example, belt-shaped and onto which the images formed by the image forming units 30 are temporarily transferred before being transferred onto the recording medium; and a simultaneous transfer device 50 that transfer the color images that have been transferred to the intermediate transfer body 40 onto the recording medium. The recording medium is supplied from a recording-medium supplying device 60, which is disposed below the image forming units 30, and is transported by a transport roller 62 disposed on a transport path 61 that extends substantially vertically. The images on the intermediate transfer body 40 are simultaneously transferred onto the recording medium in a transferring section of the simultaneous transfer device 50. The images are fixed to the recording medium by a fixing device 70 disposed in a downstream section of the transport path 61. The recording medium is ejected onto a recording-medium receiving unit 24, which will be described below, by an ejection roller 63 disposed immediately in front of the recording-medium receiving unit 24.

Each of the image forming units 30 (30*a* to 30*d*) includes a photoconductor 31 that is, for example, drum-shaped; a charging unit 32 that charges the photoconductor 31; an exposure unit 33 that is composed of, for example, a writing head of an LED print head or the like and which optically forms an electrostatic latent image on the charged photoconductor 31; a developing unit 34 which develops the electrostatic latent image on the photoconductor 31 with color toner of a predetermined color; a transfer unit 35 that transfers the developed image on the photoconductor 31 onto the intermediate transfer body 40; and a cleaning unit 36 that removes residual toner from the photoconductor 31.

Toners of different colors are supplied to the developing units 34 of the image forming units 30 from toner cartridges 38 (38*a* to 38*d*).

Each developing unit 34 uses a two-component developer that contains toner and carrier. A one-component developer, which does not contain carrier, may of course be used instead.

In the present exemplary embodiment, the intermediate transfer body 40 is wrapped around plural stretching rollers 41 to 44. The stretching roller 41, for example, serves as a driving roller for rotating the intermediate transfer body 40. An intermediate-transfer-body cleaning unit 45 is disposed downstream of the simultaneous transfer device 50 in a transporting direction of the intermediate transfer body 40. The intermediate-transfer-body cleaning unit 45 removes residual toner from the intermediate transfer body 40.

The simultaneous transfer device 50 includes a simultaneous transfer roller 51 that opposes an opposing roller, which is the stretching roller 42 for the intermediate transfer body 40. The intermediate transfer body 40 is sandwiched between the simultaneous transfer roller 51 and the opposing roller. A transfer voltage is applied across the simultaneous transfer roller 51 and the opposing roller, which is the stretching roller 42, so that a transfer electric field is generated therebetween.

Developer-Collecting System

Figure 3:
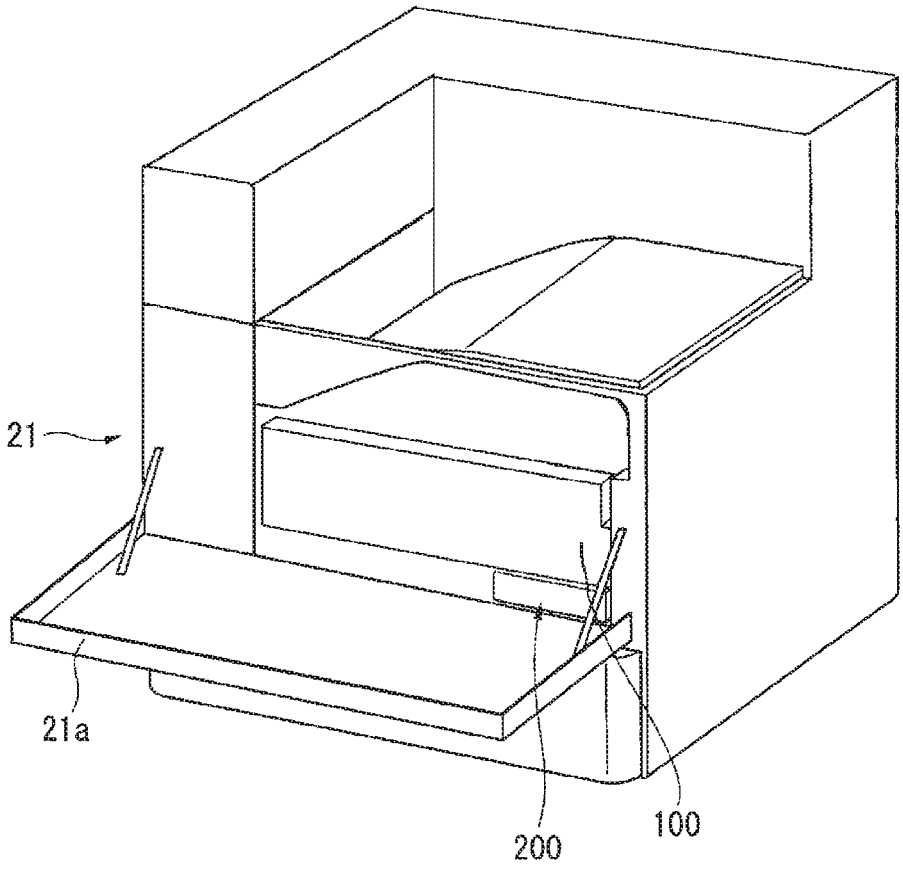
FIG. 3 illustrates the image forming apparatus according to Exemplary Embodiment 1 viewed from the user (from the front)
Figure 4:
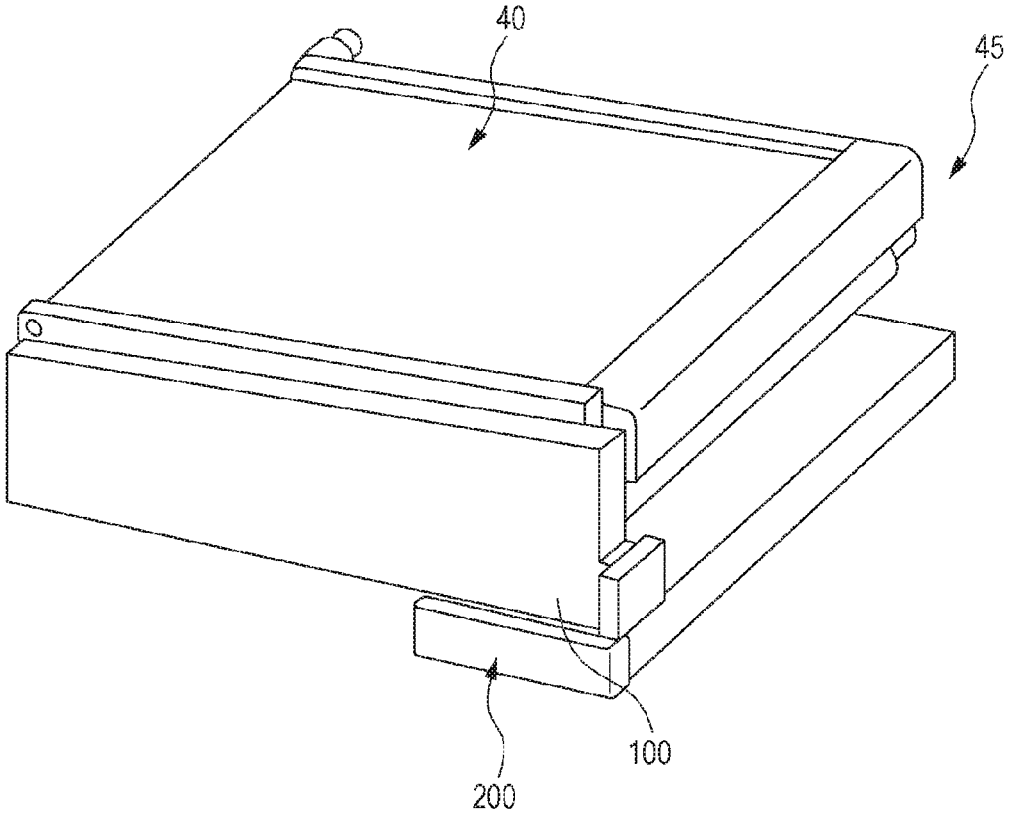
FIG. 4 illustrates a part of a developer-collecting system illustrated in FIG. 3.
Figure 5:
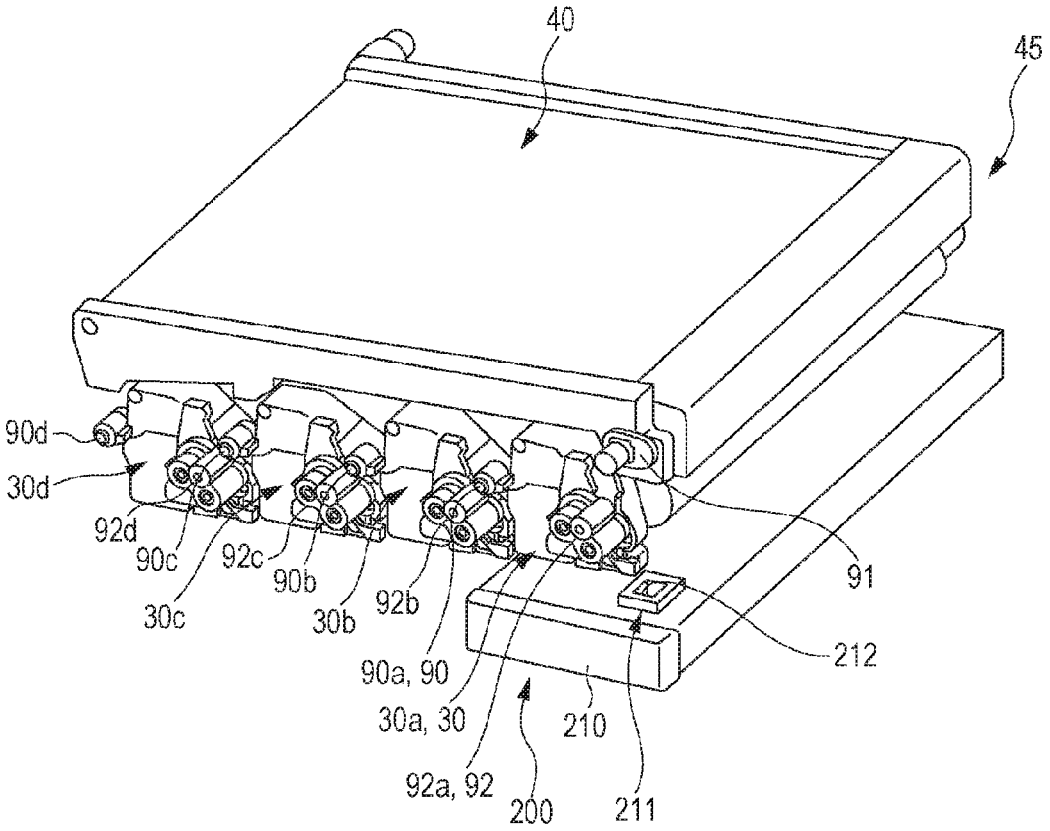
FIG. 5 illustrates the part illustrated in FIG. 4 from which a developer-transporting unit is removed.

In the present exemplary embodiment, as illustrated in FIGS. 3 to 5, a developer-collecting system, which is mounted in the housing 21, is exposed when a front covering 21*a* is opened. The front covering 21*a* is provided on the user's side (front) of the housing 21. The developer-collecting system collects the developer, which serves as powder, used in the image forming units 30 (waster toner and waste developer in this example). The developer-collecting system of this example includes a developer-transporting unit 100 and a developer-collecting box 200. The developer-transporting unit 100 collects and transports the developer from the image forming units 30 and the intermediate transfer body 40. The developer-collecting box 200 collects the developer transported by the developer-transporting unit 100 for disposal.

Developer-Transporting Unit

Figure 6:
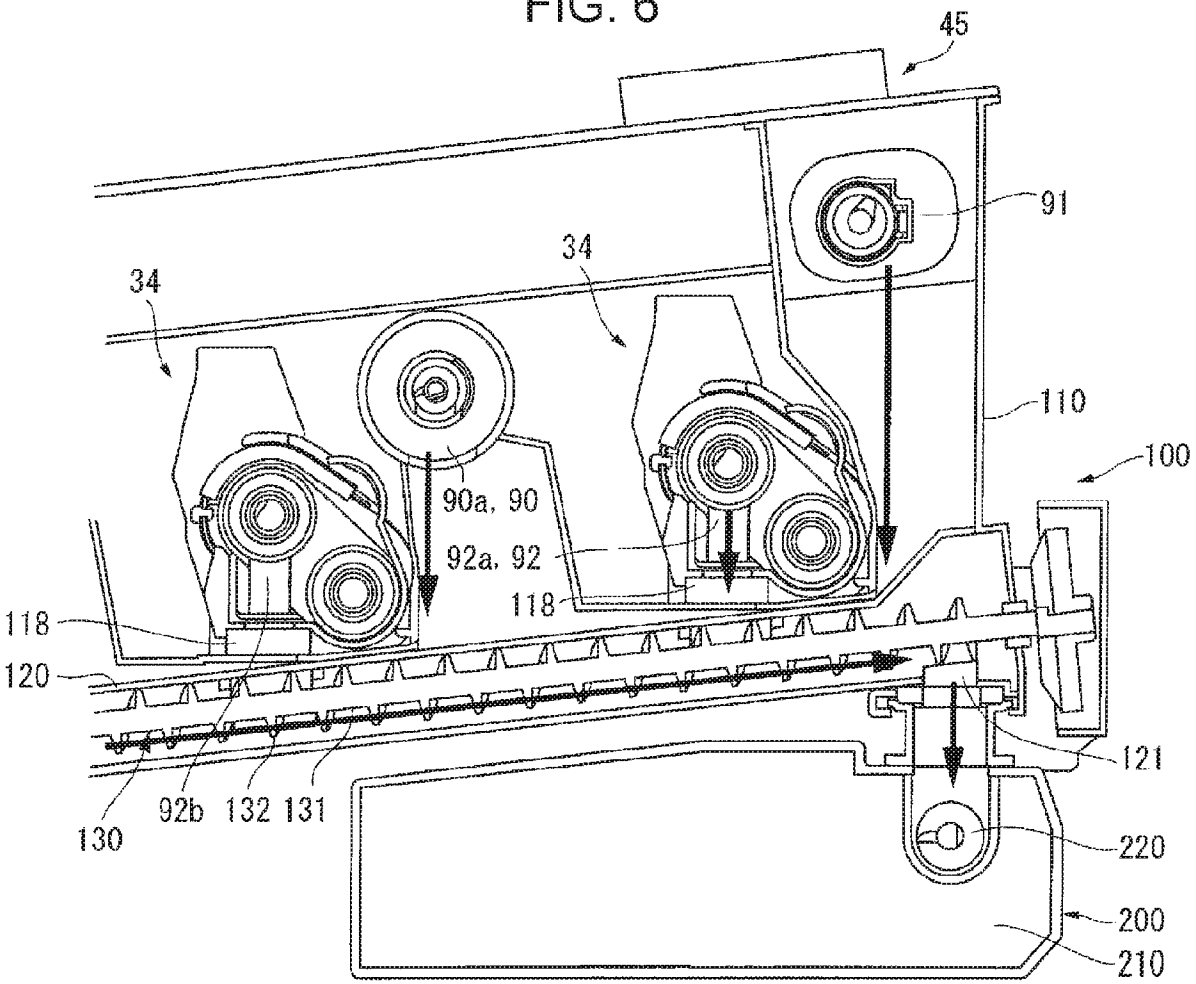
FIG. 6 illustrates the flow of developer in the developer-collecting system illustrated in FIG. 3.
Figure 7:
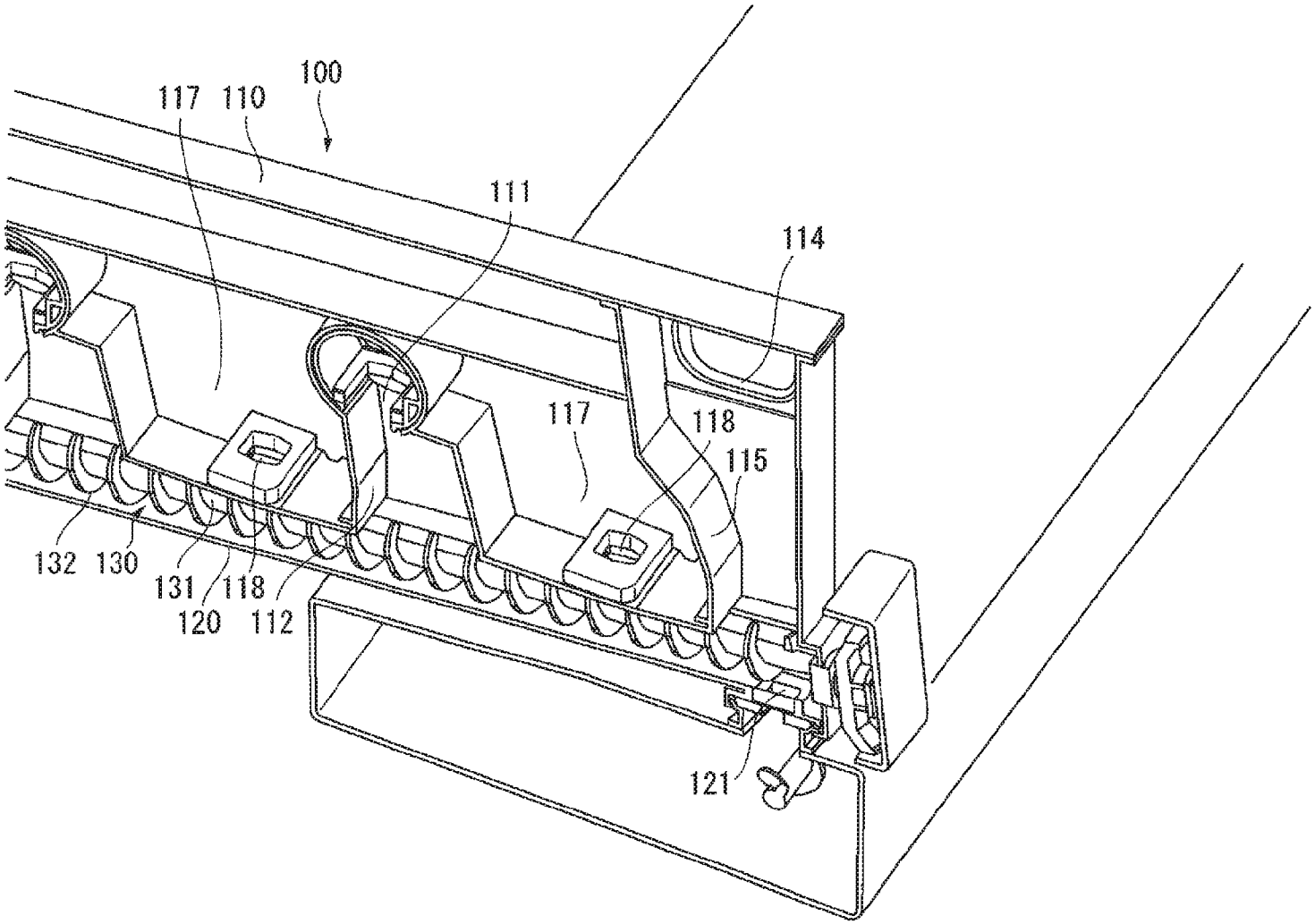
FIG. 7 illustrates the internal structure of the developer-transporting unit illustrated in FIG. 3.

In the present exemplary embodiment, the developer-transporting unit 100 is removably attachable to the housing 21 by moving the developer-transporting unit 100 in a front-to-back direction along an approximately linear path. The developer-transporting unit 100 is disposed in a front section of the housing 21 at a predetermined set position. In this example, the developer-transporting unit 100 collects the developer discharged through the following three systems:

(1) The cleaning units 36 included in the image forming units 30 (30*a* to 30*d*) remove the developer (waste toner) that remains on the photoconductors 31. Each cleaning unit 36 includes a transporting member that discharges the removed waste toner from one end of a waste container. As illustrated in FIGS. 5 to 7, the discharged waste toner is collected by the developer-transporting unit 100 through waste-toner discharging units 90 (more specifically, waste-toner discharging units 90*a* to 90*d*).

(2) The intermediate-transfer-body cleaning unit 45 removes the developer (waste toner) that remains on the intermediate transfer body 40. The intermediate-transfer-body cleaning unit 45 includes a transporting member that discharges the removed waste toner from one end of a waste container. As illustrated in FIGS. 5 to 7, the discharged waste toner is collected by the developer-transporting unit 100 through a waste-toner discharging unit 91.

(3) The developing units 34 included in the image forming units 30 (30*a* to 30*d*) each include a developing roller and plural stirring-transporting members disposed in a developing container. The stirring-transporting members charge the developer while stirring the developer. The carrier contained in the developer is not consumed and remains in the developing container. Therefore, when the carrier contained in the developer becomes old, there is a risk that the charging characteristics of the developer will be adversely affected. To avoid this, in this example, old developer (waste developer) is periodically discharged from the developing container. As illustrated in FIGS. 5 to 7, the discharged waste developer is collected by the developer-transporting unit 100 through waste-developer discharging units 92 (more specifically, waste-developer discharging units 92*a* to 92*d*).

Structure of Developer-Transporting Unit

As illustrated in FIGS. 3 to 8, in the present exemplary embodiment, the developer-transporting unit 100 includes a collecting container 110 having a substantially hollow rectangular parallelepiped shape. A transport duct 120, through which the collected developer is transported, is disposed in the collecting container 110. A transporting member 130 including, for example, a rotating shaft 131 and a helical blade 132 integrated with the rotating shaft 131 at the periphery thereof is disposed in the transport duct 120. The collected developer is transported to the developer-collecting box 200.

Collecting Opening and Discharge Opening

In this example, as illustrated in FIGS. 6 and 7, collecting openings 111 are formed in the collecting container 110. The collecting openings 111 are connectable to the waste-toner discharging units 90 for the cleaning units 36 of the image forming units 30. A connection duct 112 is disposed between each collecting opening 111 and the transport duct 120. A collecting opening 114 is also formed in the collecting container 110. The collecting opening 114 is connectable to the waste-toner discharging unit 91 for the intermediate-transfer-body cleaning unit 45. A connection duct 115 is disposed between the collecting opening 114 and the transport duct 120. Furthermore, collecting openings 117 are also formed in the collecting container 110. The collecting openings 117 are connectable to the waste-developer discharging units 92 for the developing units 34 of the image forming units 30. Connection openings 118 that are connectable to discharge openings of the waste-developer discharging units 92 are formed in the transport duct 120 at locations corresponding to the collecting openings 117.

In the present exemplary embodiment, the transport duct 120 has a discharge opening 121, which faces downward, in a downstream section thereof in the transporting direction of the developer. The discharge opening 121 is opened or closed by a shutter mechanism (not shown).

Thus, in this example, the developer-transporting unit 100 is configured so that the used developer from the image forming units 30 and the intermediate transfer body 40 is collected into the collecting container 110, dropped into the transport duct 120, transported by the transporting member 130 in the transport duct 120, and then collected into the developer-collecting box 200 through the discharge opening 121.

Developer-Collecting Box

In the present exemplary embodiment, as illustrated in FIGS. 3 to 6, the developer-collecting box 200 is disposed below the discharge opening 121 in the collecting container 110 of the developer-transporting unit 100. The developer-collecting box 200 includes a collecting container 210 having a substantially hollow rectangular parallelepiped shape that extends in a direction substantially perpendicular to the direction in which the collecting container 110 extends. The collecting container 210 includes a connection duct 211 that is connectable to the discharge opening 121 in the developer-transporting unit 100 when the developer-transporting unit 100 is at the predetermined set position. The collecting container 210 is disposed so that a connection opening 212 formed in the connection duct 211 is connected to the discharge opening 121. Furthermore, in this example, a transporting member 220 is disposed in the collecting container 210. The transporting member 220 transports the developer in the longitudinal direction of the collecting container 210 while stirring the developer. The transporting member 220 of this example includes, for example, a rotating shaft and a helical blade integrated with the rotating shaft at the periphery thereof. However, any type of transporting member may be used as long as the member has a function of transporting and stirring the developer.

Ventilation Structure for Developer-Transporting Unit

In the present exemplary embodiment, a first fan 141 (see FIG. 15) that generates airflow is disposed at one front corner of the housing 21, and a second fan (not shown) is disposed at one rear corner of the housing 21. In this example, the rear corner is diagonally opposite the location of the first fan 141. The first fan 141 generates airflow in such a direction that air is supplied to the space in the housing 21. The second fan generates airflow in such a direction that air is discharged from the housing 21. In this example, a filter (not shown) for removing powder, such as toner, is disposed in a portion of the region in which airflow is generated by the second fan.

Figure 8:
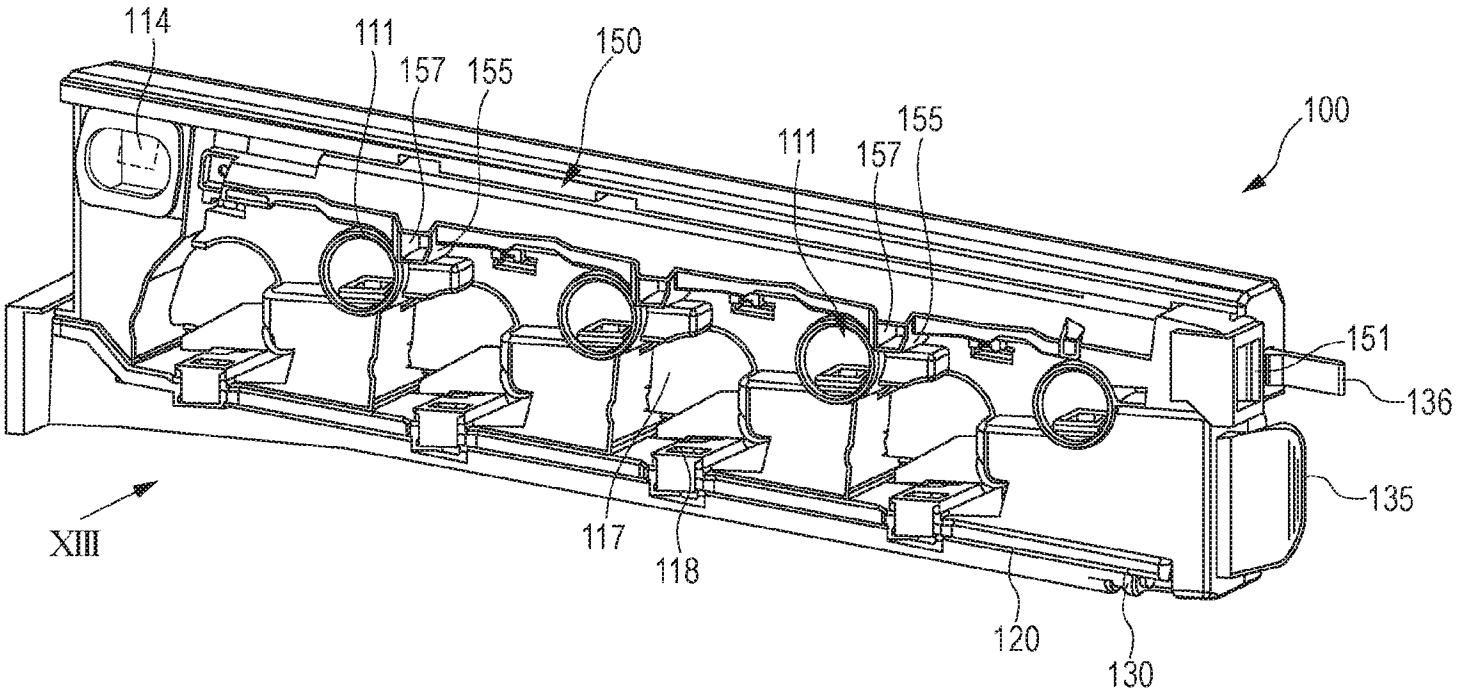
FIG. 8 illustrates an example of a ventilation structure for the developer-transporting unit according to Exemplary Embodiment 1.
Figure 9:
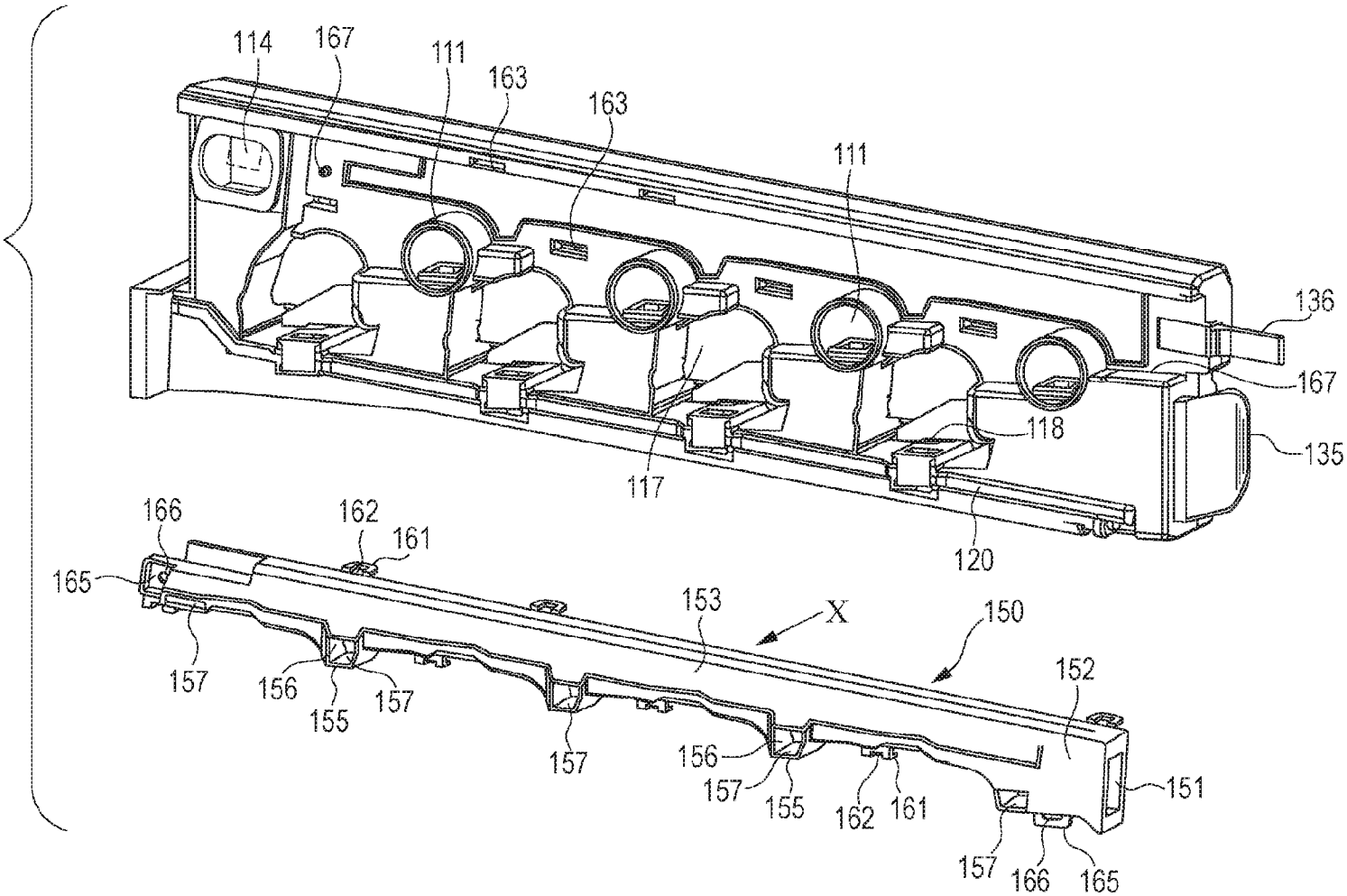
FIG. 9 illustrates the developer-transporting unit illustrated in FIG. 8 from which a ventilation duct is removed.
Figure 10:
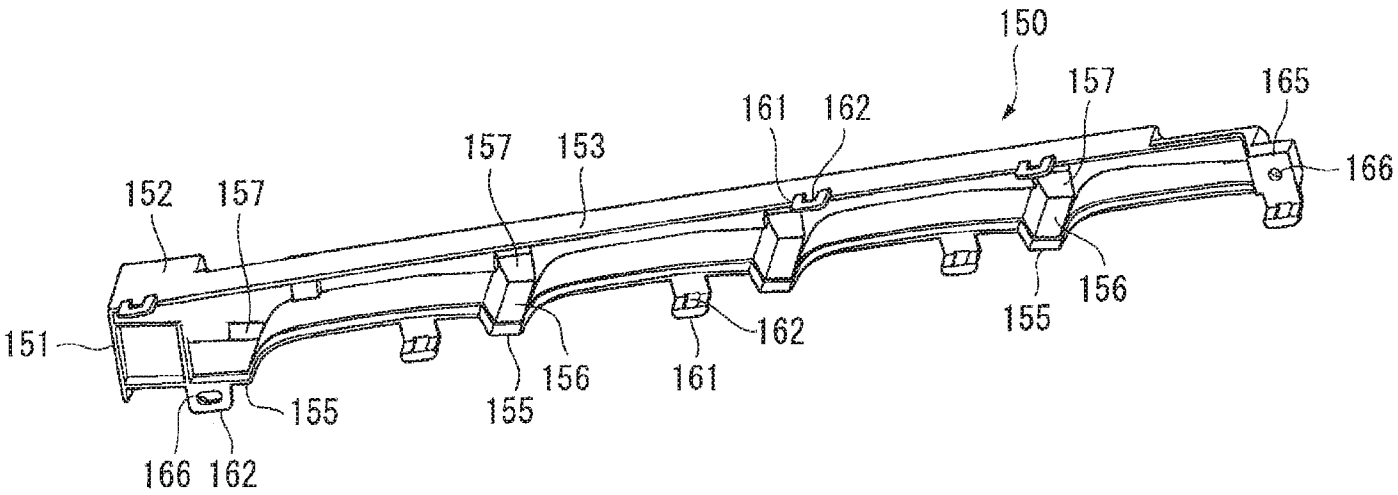
FIG. 10 illustrates the ventilation duct illustrated in FIG. 9 viewed in the direction of arrow X.
Figure 11:
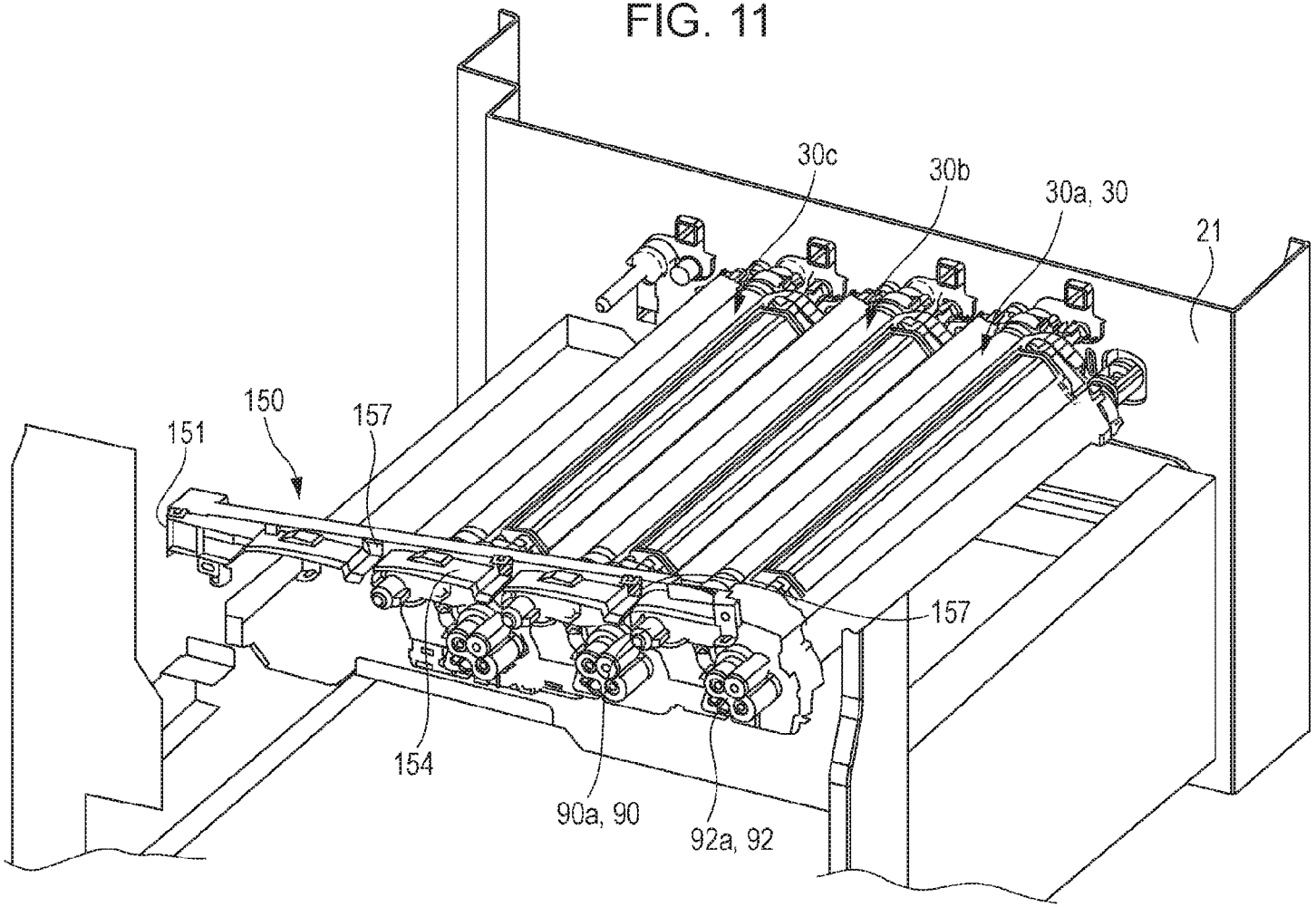
FIG. 11 illustrates the location of the ventilation duct in the image forming apparatus according to Exemplary Embodiment 1.
Figure 12:
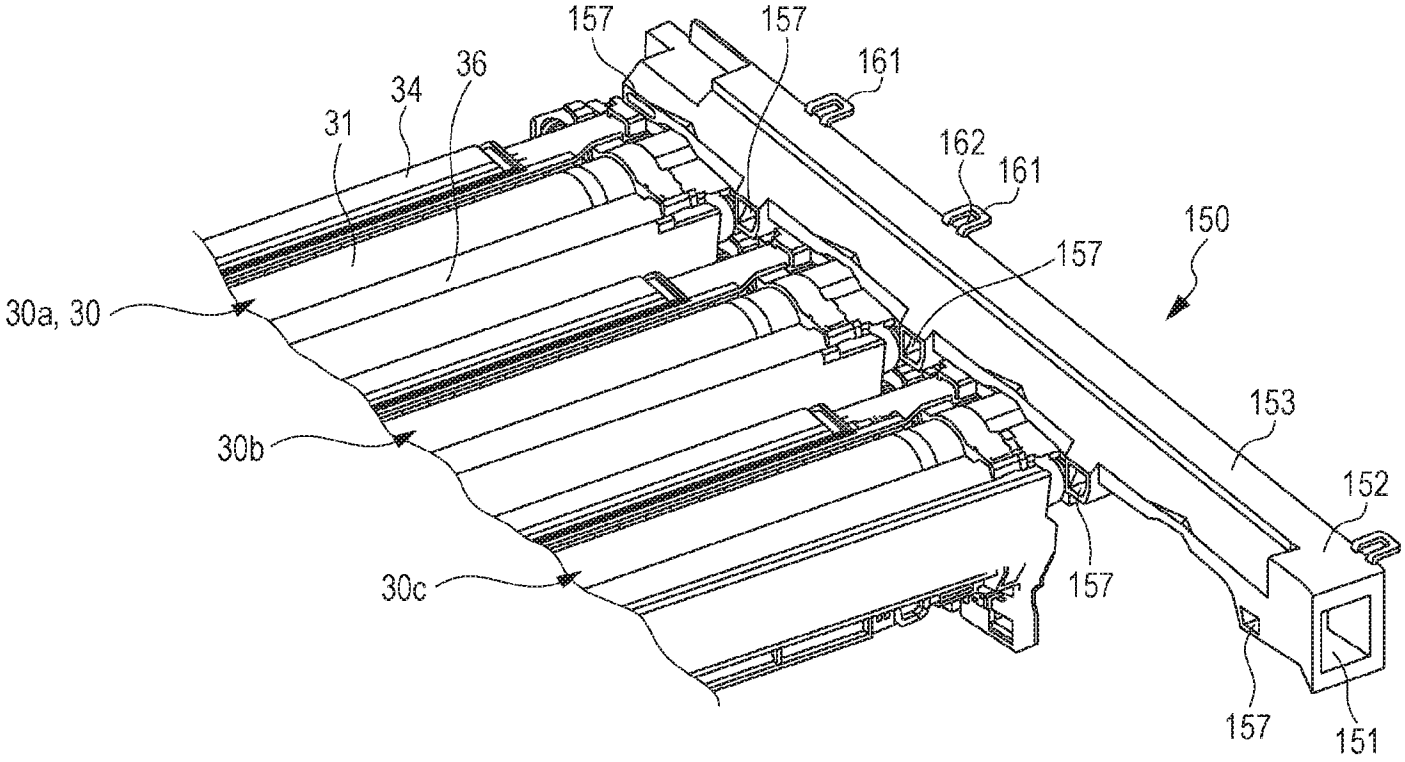
FIG. 12 illustrates a part of FIG. 11.
Figure 13:
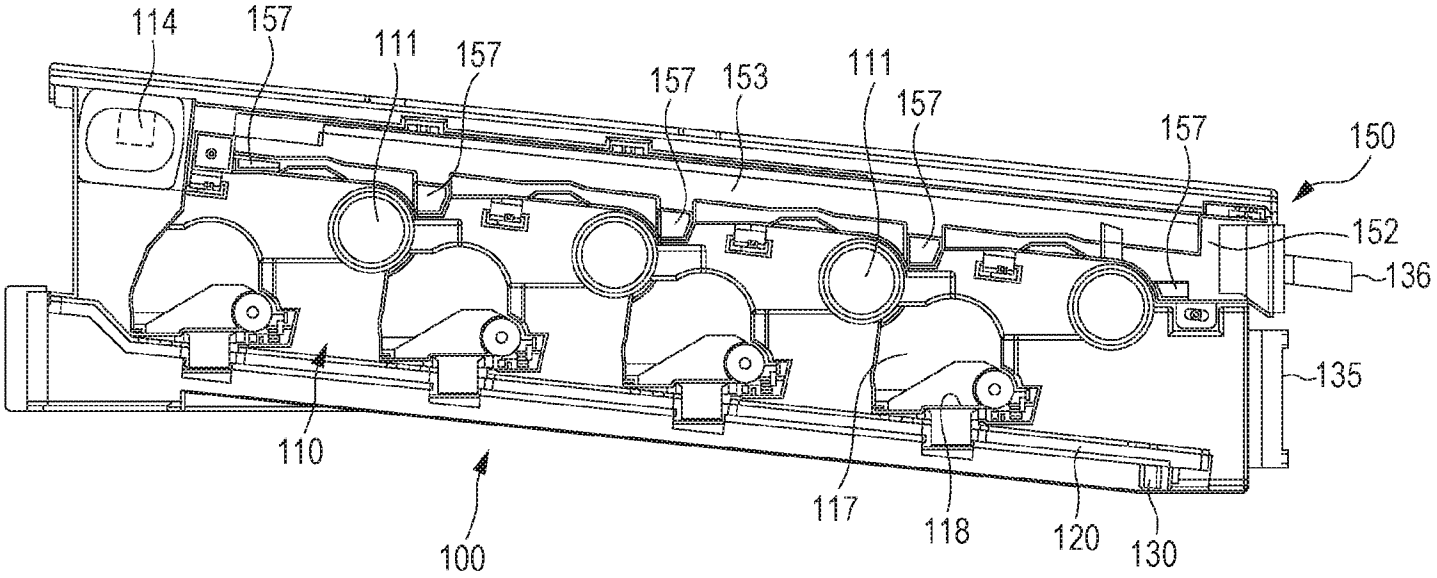
FIG. 13 illustrates the developer-transporting unit illustrated in FIG. 8 viewed in the direction of arrow XIII.
Figure 14:
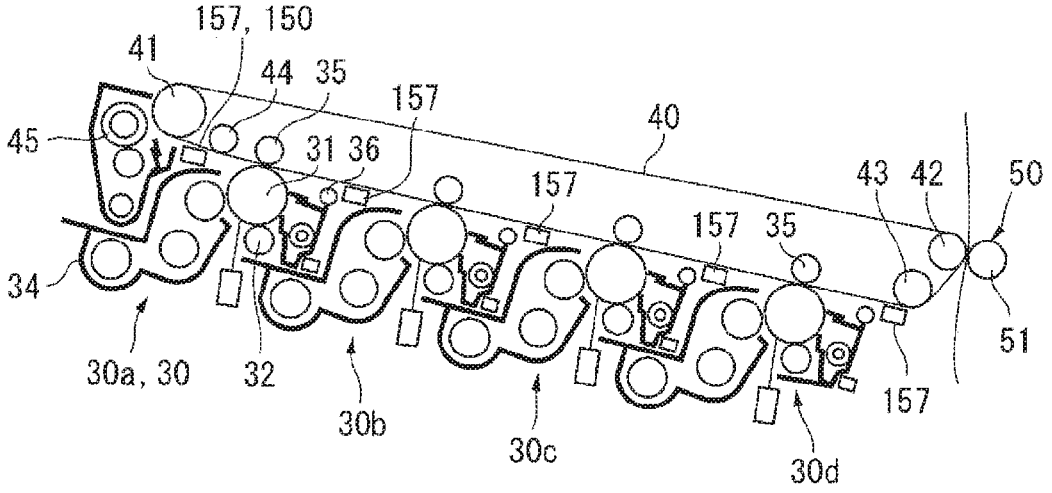
FIG. 14 illustrates the positional relationship between ventilation holes in the ventilation duct and image forming units according to Exemplary Embodiment 1.

In the present exemplary embodiment, as illustrated in FIGS. 8 to 10, the developer-transporting unit 100 includes a ventilation duct 150 that is removably attached to an exterior wall (inner exterior wall) of the collecting container 110 that faces the space in the housing 21.

Structure of Ventilation Duct

In the present exemplary embodiment, the ventilation duct 150 is a long member that extends in a longitudinal direction of the collecting container 110 (axial direction of the transporting member 130) along an upper section of the inner exterior wall of the collecting container 110. An end portion of the ventilation duct 150 near the first fan 141 has an inlet 151 through which the airflow from the first fan 141 is introduced. The ventilation duct 150 includes a tubular portion 152, which has a substantially rectangular cross section, in a region near the inlet 151, and a channel portion 153, which has a substantially U-shaped cross section, in a region other than the region of the tubular portion 152. In this example, the ventilation duct 150 includes a ventilation passage 154 that is connected to the inlet 151 in the tubular portion 152 and that is defined between the channel portion 153 and the inner exterior wall of the collecting container 110 in the region other than the region of the tubular portion 152.

The channel portion 153 of the ventilation duct 150 includes a pair of arms, and plural protruding portions 155 that protrude downward are formed on the lower one of the pair of arms. Each protruding portion 155 has a recessed groove 156 that extends over the entire length of the protruding portion 155 in the direction in which the arms of the channel portion 153 project. Each recessed groove 156 has an opening that functions as a ventilation hole 157 at the end thereof near the connecting portion between the arms of the channel portion 153.

Figure 15:
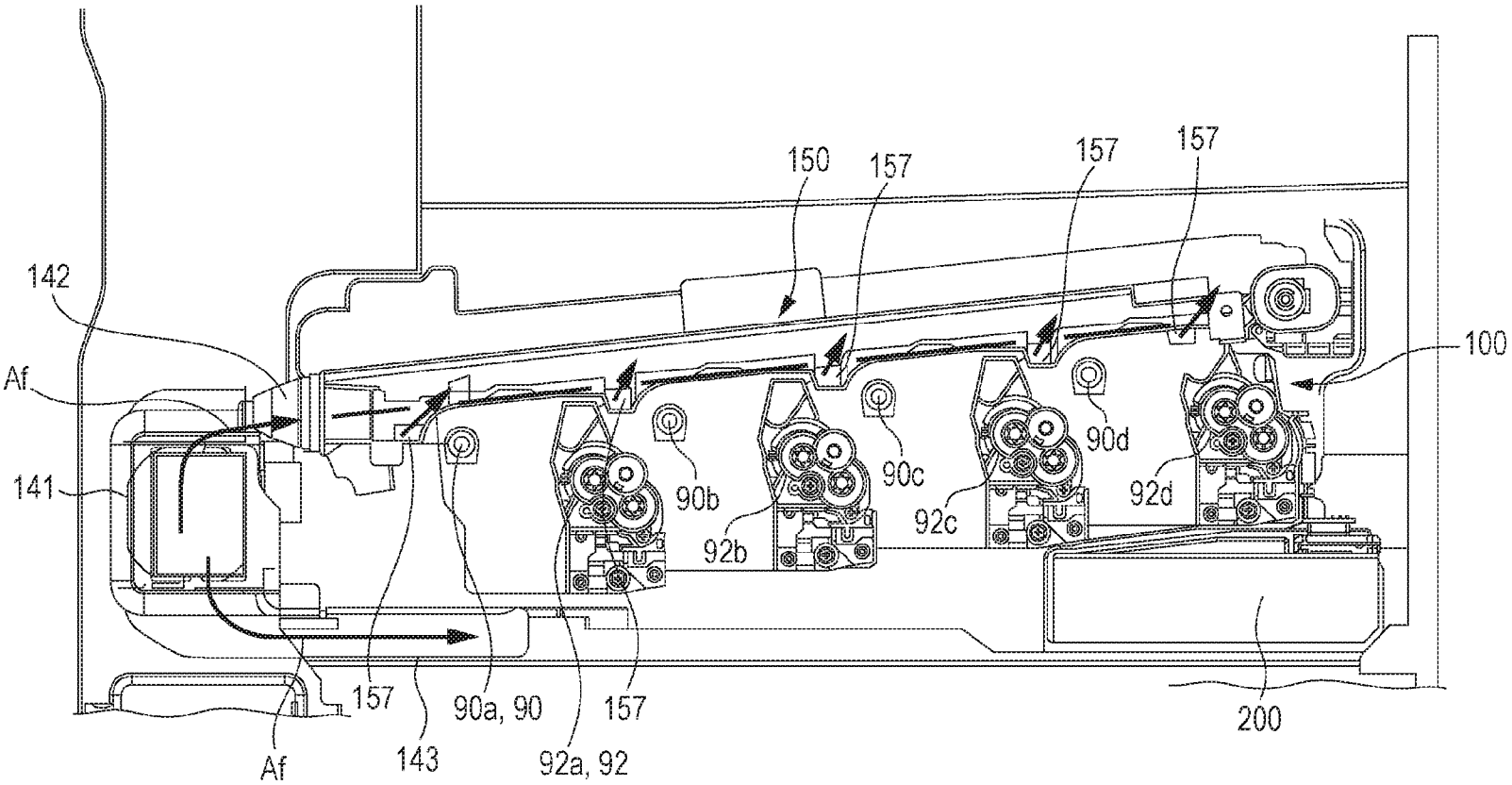
FIG. 15 illustrates airflow through the ventilation duct according to Exemplary Embodiment 1.

In the present exemplary embodiment, as illustrated in FIG. 15, an upper branch pipe 142 that extends upward is disposed near the first fan 141. The upper branch pipe 142 is connected to the inlet 151 of the ventilation duct 150. Referring to FIGS. 8 and 9, a grip portion 135 is held by a user when the developer-transporting unit 100 is attached or removed. The developer-transporting unit 100 is retained in the housing 21 by a hook 136.

Ventilation Duct Attachment Structure

The ventilation duct 150 includes plural substantially L-shaped attachment portions 161 on the top and bottom longitudinal edges thereof. In this example, four attachment portions are provided at the bottom, and three attachment portions are provided at the top. Each attachment portion 161 is formed of an elastically deformable plate, and has an engagement hole 162.

Attachment holes 163 that correspond to the attachment portions 161 of the ventilation duct 150 are formed in the exterior wall of the collecting container 110 to which the ventilation duct 150 is attached. Each attachment hole 163 has an engagement step portion (not shown) that is engageable with the engagement hole 162 in the corresponding attachment portion 161. Positioning portions 165 are provided near both ends of the ventilation duct 150 in the longitudinal direction. The positioning portions 165 have positioning holes 166 formed therein. Positioning pins 167 that correspond to the positioning holes 166 in the ventilation duct 150 are formed on the exterior wall of the collecting container 110.

Referring to FIG. 9, when the ventilation duct 150 is attached to the collecting container 110, the ventilation duct 150 is positioned so that the two positioning pins 167 on the collecting container 110 extend through the respective positioning holes 166 in the ventilation duct 150. After that, the ventilation duct 150 is pushed against the collecting container 110. In this state, the attachment portions 161 of the ventilation duct 150 are inserted into the respective attachment holes 163 in the collecting container 110, and the engagement step portions (not shown) are snap-fitted into the engagement holes 162 in the respective attachment portions 161, so that the attachment portions 161 are attached to the attachment holes 163.

When the ventilation duct 150 is removed from the collecting container 110, the user may hold portions of the ventilation duct 150 near both ends thereof in the longitudinal direction, and pull the ventilation duct 150 away from the collecting container 110. Accordingly, the attachment portions 161 snap out of the attachment holes 163, and the ventilation duct 150 is removed from the collecting container 110.

Example of Arrangement of Ventilation Duct and Ventilation Hole

In the present exemplary embodiment, the collecting container 110 of the developer-transporting unit 100 has the collecting openings 111 connectable to the waste-toner discharging units 90 for the cleaning units 36; the collecting opening 114 connectable to the waste-toner discharging unit 91 for the intermediate-transfer-body cleaning unit 45; and the collecting openings 117 connectable to the waste-developer discharging units 92 for the developing units 34. In this example, the waste toner discharged from the cleaning units 36 has a higher toner density, and therefore melts more easily, than the waste toner discharged from the intermediate-transfer-body cleaning unit 45 and the waste toner contained in the waste developer discharged from the developing unit 34.

Accordingly, in the present exemplary embodiment, as illustrated in FIG. 8, the ventilation duct 150 is disposed so as to pass by the collecting openings 111 (four collecting openings 111 in this example) connectable to the waste-toner discharging units 90 of the cleaning units 36. Thus, the airflow Af that flows through the ventilation duct 150 cools the regions around the collecting openings 111.

In addition, in the present exemplary embodiment, the ventilation passage 154 of the ventilation duct 150 is partitioned from the space in the collecting container 110. Therefore, the airflow Af in the ventilation passage 154 does not flow into the space in the collecting container 110, and the waste toner and waste developer collected into the collecting container 110 are not blown away by the airflow Af.

In the present exemplary embodiment, the ventilation duct 150 has five ventilation holes 157. As illustrated in FIGS. 9 to 14, the ventilation holes 157 are arranged so as to face the image forming units 30 (30*a* to 30*d*) in the housing 21.

More specifically, as illustrated in FIGS. 11 to 15, the ventilation holes 157 face the spaces above or beside the cleaning units 36 or the spaces above the developing units 34. Also, the ventilation holes 157 face the space below the intermediate transfer body 40.

Therefore, in the present exemplary embodiment, as indicated by the arrows in FIG. 15, the airflow Af generated by the first fan 141 flows through the upper branch pipe 142, enters the ventilation passage 154 through the inlet 151 of the ventilation duct 150, and flows toward the image forming units 30 (30*a* to 30*d*) through the ventilation holes 157.

Since the ventilation holes 157 face the spaces above or beside the cleaning units 36, the airflow Af that flows into the housing 21 from the ventilation holes 157 cools the regions around the transporting members of the waste-toner discharging units 90.

In addition, since the ventilation holes 157 face the spaces above the developing units 34, even when a toner cloud is generated around the developing units 34, the airflow Af that flows out of the ventilation holes 157 blows away the toner cloud in a predetermined direction. In addition, in this example, the second fan (not shown) generates airflow in a discharging direction, so that the toner cloud blown away in the predetermined direction is further blown by the airflow Af generated by the second fan. In this state, since a filter is disposed at an intermediate location of the path of the airflow Af, the toner cloud is effectively collected by the filter.

In addition, in the present embodiment, the ventilation holes 157 face the space below the intermediate transfer body 40. Therefore, the airflow Af discharged from the ventilation holes 157 flows along the surface of the intermediate transfer body 40 in the front-to-back direction of the housing 21, so that the toner cloud and dust do not easily adhere to the surface of the intermediate transfer body 40. In particular, in the space between two adjacent image forming units 30, the airflow Af discharged from the corresponding ventilation hole 157 flows in the front-to-back direction of the housing 21 through a passage space surrounded by the intermediate transfer body 40, the developing unit 34 of one of the two adjacent image forming units 30, and the cleaning unit 36 of the other of the two adjacent image forming units 30.

Lower Ventilation Structure of Housing

In the present exemplary embodiment, a lower ventilation structure that cools the image forming units 30 (30*a* to 30*d*) from below is disposed in a lower section of the housing 21.

Referring to FIG. 15, this lower ventilation structure includes a lower branch pipe 143 that is disposed near the first fan 141 and extends downward. The lower branch pipe 143 is connected to a lower ventilation duct (not shown) that is separated from the ventilation duct 150 of the developer-transporting unit 100. The lower ventilation duct has an inlet (not shown) that is connected to the lower branch pipe 143, and ventilation holes (not shown) that faces the spaces below the image forming units 30.

According to the present exemplary embodiment, the airflow Af from the first fan 141 is guided to the lower ventilation duct (not shown) through the lower branch pipe 143, and is discharged toward the image forming units 30 (30*a* to 30*d*).

In this example, the airflow Af from the ventilation holes in the lower ventilation duct (not shown) flows toward the developing units 34, the cleaning units 36, and the exposure units 33 of the image forming units 30, and cools these units. For example, in each developing unit 34, when a layer-thickness regulating member (not shown) comes into contact with the developing roller, a large amount of heat is generated due to wearing of the layer-thickness regulating member. However, the amount of heat generated due to wearing of the layer-thickness regulating member may be effectively reduced by the airflow Af from the lower ventilation duct. In addition, even when each cleaning unit 36 generates heat due to wearing of the waste-toner transporting member, or when each exposure unit 33 generates heat, the amount of heat generated may be effectively reduced by the airflow Af from below.

Maintenance of Image Forming Units and Intermediate Transfer Body

When, for example, maintenance is performed on the photoconductors 31 or the developing units 34 of the image forming units 30 (30*a* to 30*d*) or on the intermediate transfer body 40, the image forming units 30 and the intermediate transfer body 40 may be removed toward the front after removing the developer-transporting unit 100 disposed at the front of the housing 21. Since the ventilation duct 150 is attached to the developer-transporting unit 100, it is not necessary to remove the ventilation duct 150 when the developer-transporting unit 100 is removed together with the ventilation duct 150.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder collecting device comprising:

a collecting container that is removably attachable to a housing of a processing apparatus including a powder processing unit, that has one or more collecting openings through which heat-melting powder transported from the powder processing unit is collected, and that includes an accommodation space capable of accommodating the collected powder; and a ventilation passage that is partitioned from the accommodation space of the collecting container, through which airflow generated by an airflow generator passes, that extends in a longitudinal direction of the collecting container, and that has an inlet through which the airflow is introduced and a ventilation hole formed in a downstream section of the ventilation passage in a direction of the airflow.

2. The powder collecting device according to claim 1, wherein the ventilation passage passes by at least one of the one or more collecting openings.

3. The powder collecting device according to claim 1, wherein the ventilation hole opens toward a space around the powder processing unit.

4. The powder collecting device according to claim 1, wherein a member that defines the ventilation passage is removably attachable to the collecting container.

5. The powder collecting device according to claim 1, wherein a member that defines the ventilation passage is attached to an exterior wall of the collecting container.

6. The powder collecting device according to claim 1, wherein the ventilation passage is disposed above the one or more collecting openings in the collecting container.

7. The powder collecting device according to claim 1, wherein the collecting container contains a transporting member that is disposed below the one or more collecting openings and that transports the collected powder, wherein the collecting container has a discharge opening at a bottom of a downstream section of the collecting container in a direction in which the transporting member transports the powder, and wherein the powder is discharged through the discharge opening and stored in a disposal container.

8. A processing apparatus comprising:

one or more powder processing units that are disposed in a housing and that perform a process by using powder; and the powder collecting device according to claim 1 that collects the powder transported from the one or more powder processing units.

9. The processing apparatus according to claim 8, further comprising:

a first airflow generator that is disposed at one front corner of the housing and that generates airflow toward the inlet of the ventilation passage; and a second airflow generator that is disposed at one rear corner of the housing, the rear corner being diagonally opposite a location of the first airflow generator, and that generates airflow in such a direction that airflow that has flowed into a space in the housing from the ventilation hole in the ventilation passage flows out of the housing.

10. The processing apparatus according to claim 8, further comprising:

an airflow generator that is disposed at one front corner of the housing and that generates airflow;

an upper branch pipe through which a portion of the airflow generated by the airflow generator branches off upward and is guided to the inlet of the ventilation passage;

a lower branch pipe through which a portion of the airflow generated by the airflow generator branches off downward; and a lower ventilation passage that is disposed below the one or more powder processing units in the housing, that is partitioned from a space in the housing, and that has an inlet connected to the lower branch pipe and a ventilation hole that opens toward a space below the one or more powder processing units.

11. The processing apparatus according to claim 8, wherein each of the one or more powder processing units includes an image carrier capable of carrying an electrostatic latent image, a developing device that develops the electrostatic latent image on the image carrier into a visible image by using developer that serves as the powder, a transfer device that transfers the visible image developed by the developing device onto a recording medium, and a cleaning device that removes the developer that remains on the image carrier, and wherein the powder collecting device collects the developer transported from at least one of the cleaning device, the transfer device, or the developing device.

12. The processing apparatus according to claim 11, wherein the powder collecting device collects at least the developer transported from the cleaning device, and wherein the ventilation hole in the ventilation passage faces a space above or beside the cleaning device of each powder processing unit or a space above the developing device of each powder processing unit.

13. The processing apparatus according to claim 11, wherein the transfer device includes an intermediate transfer body onto which the visual image formed on the image carrier by using the developer is intermediately transferred before being transferred onto the recording medium, the intermediate transfer body being disposed above the image carrier, and wherein the ventilation hole in the ventilation passage faces a space below the intermediate transfer body.

* * * * *